US005791591A

United States Patent [19]

Hoban

[11] Patent Number: 5,791,591

[45] Date of Patent: Aug. 11, 1998

[54] TARGET SEEKING FREE GYRO

[75] Inventor: Fay Hoban, Ridgecrest, Calif.

[73] Assignee: The United States of America as represented by the Secretary of the Navy, Washington, D.C.

[21] Appl. No.: 846,203

[22] Filed: Apr. 28, 1997

[51] Int. Cl.[6] ..... F41G 7/00; G01C 19/30

[52] U.S. Cl. ..... 244/3.16; 74/5.46

[58] Field of Search ..... 244/3.16, 3.2; 74/5.22, 5.46, 5.6 E

[56] References Cited

U.S. PATENT DOCUMENTS

| | | | |
|---|---|---|---|
| 3,974,985 | 8/1976 | Campbell | 244/3.16 |
| 4,185,797 | 1/1980 | McLean | 244/3.16 |
| 4,191,346 | 3/1980 | McLean | 244/3.16 |
| 4,210,804 | 7/1980 | LaTorre et al. | 244/3.16 |
| 4,231,534 | 11/1980 | R. Lintell et al. | 244/3.16 |
| 4,290,316 | 9/1981 | Noar et al. | 74/5.46 |
| 4,309,005 | 1/1982 | McLean | 244/3.16 |
| 4,413,177 | 11/1983 | Godwin, Jr. et al. | 244/3.16 |
| 4,487,083 | 12/1984 | Quermann | 74/5.46 |
| 4,520,973 | 6/1985 | Clark et al. | 244/3.16 |
| 4,885,977 | 12/1989 | Kirson et al. | 89/41.05 |
| 5,219,132 | 6/1993 | Beckerleg et al. | 244/3.16 |
| 5,262,630 | 11/1993 | Kordulla | 244/3.16 |
| 5,279,479 | 1/1994 | Adama et al. | 244/3.16 |

*Primary Examiner*—Charles T. Jordan
*Assistant Examiner*—Theresa M. Wesson
*Attorney, Agent, or Firm*—Melvin J. Sliwka; David S. Kalmbaugh

[57] ABSTRACT

A free gyro for use with a missile's seeker which allows the seeker to track the target. The free gyro includes a support structure having a pair of roll axis forks which support a pitch gimbal and allow for rotational movement of the pitch gimbal about a pitch axis. Attached to the pitch gimbal is an outer gimbal support structure which includes a U shaped support member having a pair of support posts which support an outer gimbal ring and allow for rotational movement of the outer gimbal ring about the pitch axis. The outer gimbal ring supports and provides for rotational movement of an inner gimbal ring about an inner gimbal axis which is perpendicular to the pitch axis. The inner gimbal ring supports the free gyro assembly and allows the free gyro assembly to spin about a roll axis to stabilize the free gyro assembly. The free gyro assembly includes the optical system for the missile's seeker or tracking device and the support structure for the optical system. The free gyro has a gimbal drive and control system comprising gyro motor drive coils, precession coils, cage coils and permanent magnets which are integral to the pitch gimbal, the outer gimbal and the inner gimbal and are used to control and position the gimbals of the free gyro as the missile's seeker tracks and then locks onto the target.

20 Claims, 5 Drawing Sheets

TARGET SEEKING FREE GYRO

BACKGROUND OF THE INVENTION

1. Field of the Invention

The present invention relates generally to target tracking devices for use in guided vehicles. In particular, the present invention relates to a free gyro having a seeker system for tracking a target which is adapted for use with guided missiles, torpedoes and the like and which provides for plus or minus one hundred twenty degree gimbal angle acquisition of the target.

2. Description of the Prior Art

The use of seeker systems and similar state of the art tracking devices in guided missiles and the like is well known. A typical tracking device, such as a seeker system, is mounted in the nose of the carrying vehicle and generally comprises a lens system, a sensing element and suitable electronics. An image of the target the missile is tracking may be an actual optical image, a heat image or some other type of image. The image sensed by the tracking device will depend upon the type of lens system and sensing unit used with the carrying vehicle which may be, for example, a missile. The sensing unit converts information it receives from the target image into signals which travel through the electronics and drive various servomechanisms to keep the tracking device locked on the target and to navigate the missile toward the target.

A free gyro is a type of servomechanism which may be used to keep the tracking device or seeker of the missile locked on the target and to navigate the missile toward the target. In the past free gyros have used off axis drive torquers and their gear drives and chains or belts as the drive system for both the pitch axis and the free gyro gimbal system. While the prior art off axis drive torquers are adequate drive systems for the free gyro, they require a number of systems components which are generally very expensive and require a considerable amount of space making them somewhat incompatible with the space limitations of small guided missile. In addition, two axis free gyros have generally limited target acquisition capabilities and are unable to acquire targets beyond eighty degrees. There is a need for greater accuracy in the tracking capabilities of the gyros used in these missiles which they are unable to provide.

Accordingly, it is an object of the present invention to provide a cost effective yet highly reliable free gyro which allows a sensing element seeker to track a target accurately.

It is another object of the present invention to provide a highly accurate free gyro which may be packaged in the nose of a small guided missile.

It is still another object of the present invention to provide a free gyro with target acquisition capabilities of at least one hundred twenty degrees.

It is yet another object of the present invention to eliminate off axis torquers and their gears drive and chains or belts as the drive systems for both the pitch axis and the free gyro gimbal system.

These and other objects, novel features and advantages of the present invention and the manner of realizing them will become more apparent and the invention will be best understood from a study of the following description and appended claims, with reference to the attached drawings.

SUMMARY OF THE INVENTION

According to the present invention, briefly stated, there is provided a free gyro for use with a missile's tracking device, such as a seeker, which allows the tracking device or seeker of the missile to lock on the target and to navigate the missile toward the target. The free gyro of the present invention provides a target acquisition angle of plus or minus one hundred twenty degrees.

The present invention comprises a free gyro which is positioned within the dome of the missile. The free gyro includes a support structure having a pair of roll axis forks which support a pitch gimbal and allow for rotational movement of the pitch gimbal about a pitch axis through an angle of rotation of approximately ±120 degrees. Attached to the pitch gimbal is an outer gimbal support structure which includes a stem and a generally U shaped support member. The U shaped support member has a pair of support posts which support an outer gimbal ring and allow for rotational movement of the outer gimbal ring about the pitch axis through an angle of rotation of approximately ±20 degrees.

The outer gimbal ring supports and provides for rotational movement of an inner gimbal ring about an inner gimbal axis which is perpendicular to the pitch axis. The angle of rotation of the inner gimbal ring about the inner gimbal axis is approximately ±20 degrees.

The inner gimbal ring supports the free gyro assembly and allows the free gyro assembly to spin about a roll axis to stabilize the free gyro assembly. The free gyro assembly includes the optical system for the missile's seeker or tracking device and the support structure for the optical system.

The free gyro has a gimbal drive and control system comprising gyro motor drive coils, precession coils, cage coils and permanent magnets which are integral to the pitch gimbal, the outer gimbal and the inner gimbal and are used to control and position the gimbals of the free gyro as the missile's seeker tracks and then locks onto the target.

DETAILED DESCRIPTION OF THE PREFERRED EMBODIMENT

Referring first to the figures of drawings, in which like numerals are used to indicate like parts. The several Figures of the drawings describe the free gyro of the present invention as if it were for use in a relatively small guided missile, i.e. one having a diameter of from a about 24 inches to 8 inches or less. However, it should be understood that the present invention could be easily adapted for use in underwater vehicles such as torpedoes and the like or for space vehicles other than missiles.

Figure 1:
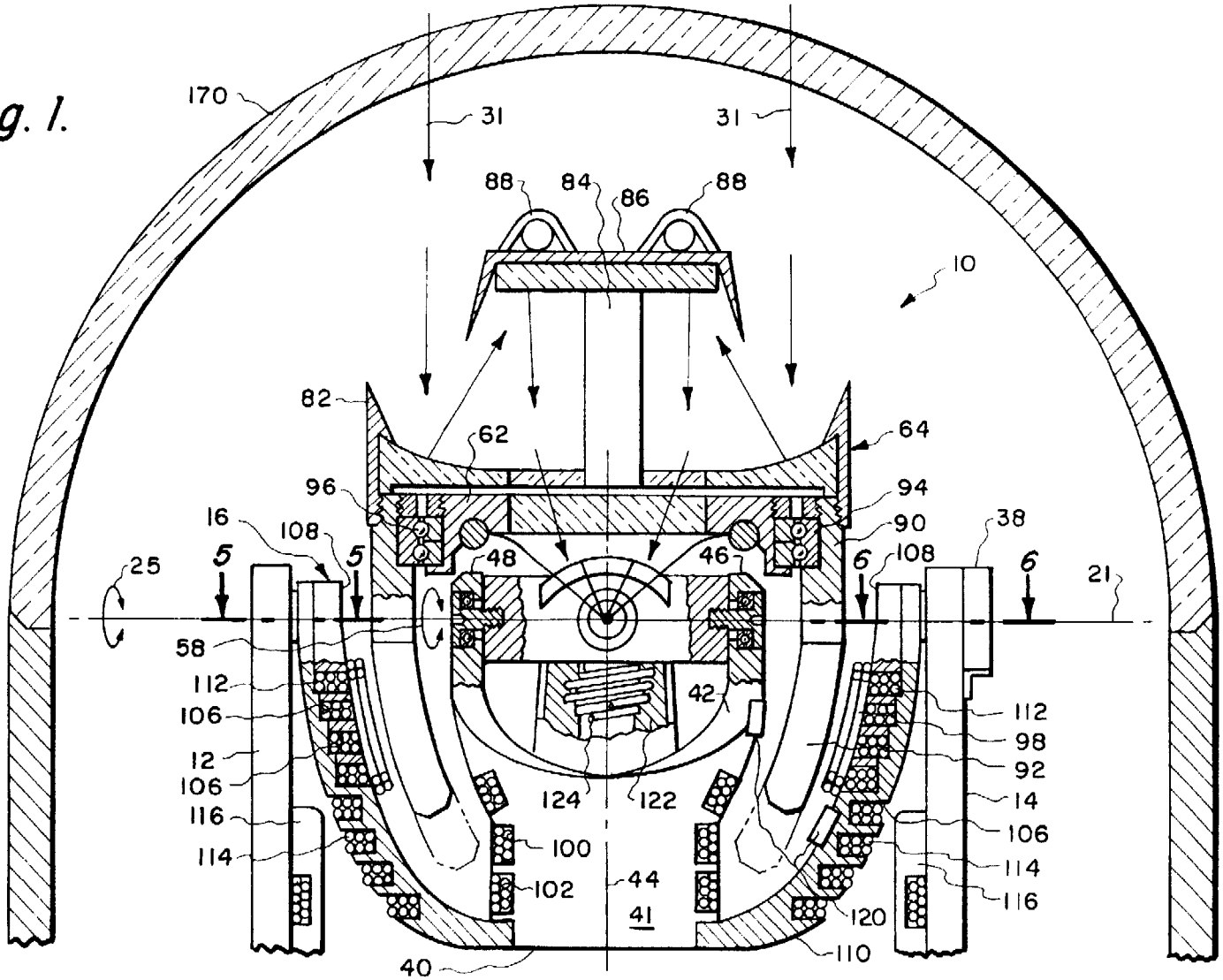
FIG. 1 is a detailed diagrammatic view, in partial section, of the free gyro constituting the present invention.
Figure 4:
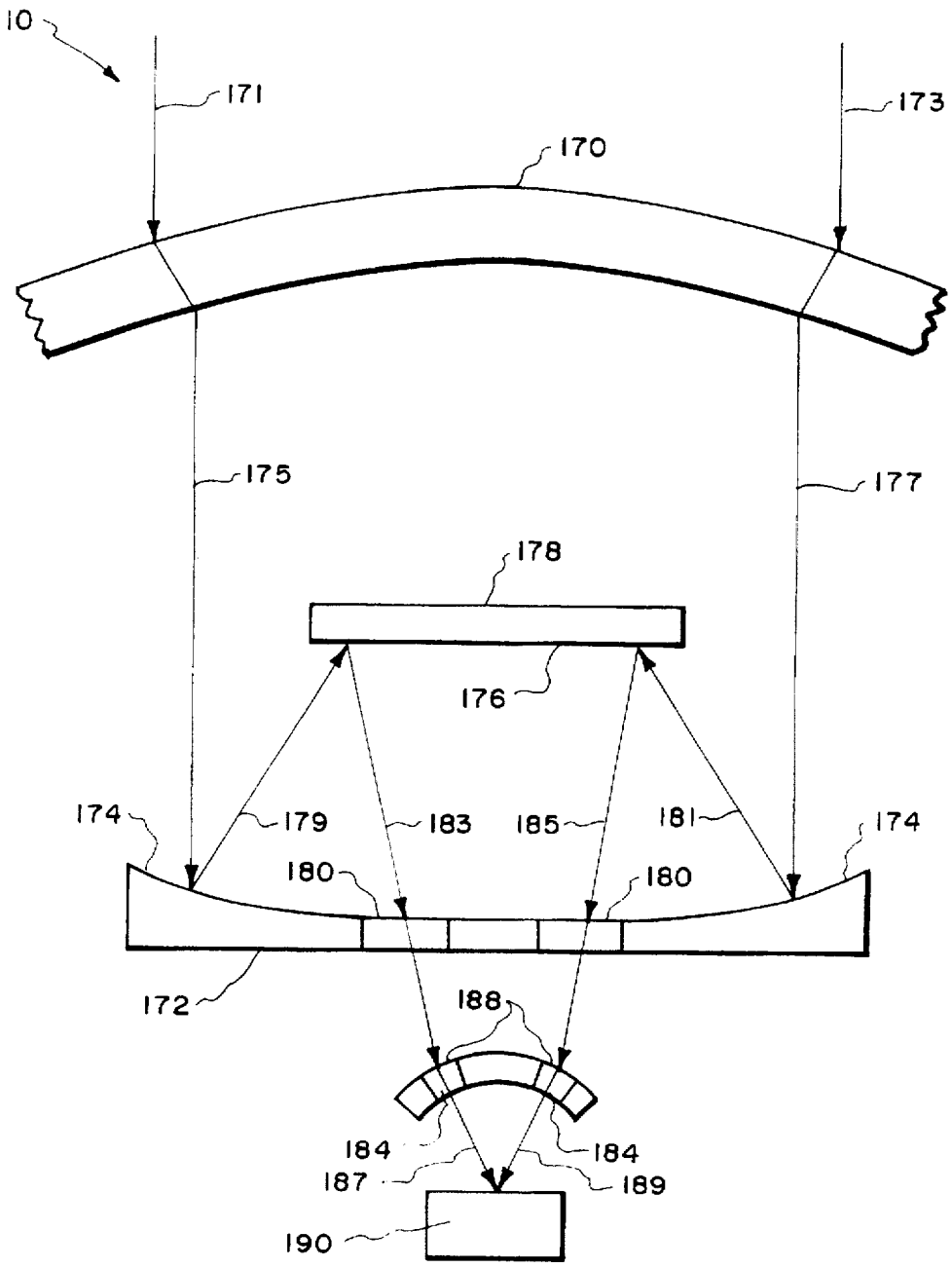
FIG. 4 is a plan view of a lens system suitable for use in the free gyro of FIG. 1.

Referring first to FIG. 1, there is shown a free gyro, designated generally by the reference numeral 10, which is adapted for use with the seeker 190, FIG. 4, of a missile or the like. The seeker 190 and the free gyro's optical system (illustrated in FIG. 4), in turn, receives electromagnetic radiation or energy (illustrated by arrows 31 in FIG. 1), reflected from the target.

Figure 5:
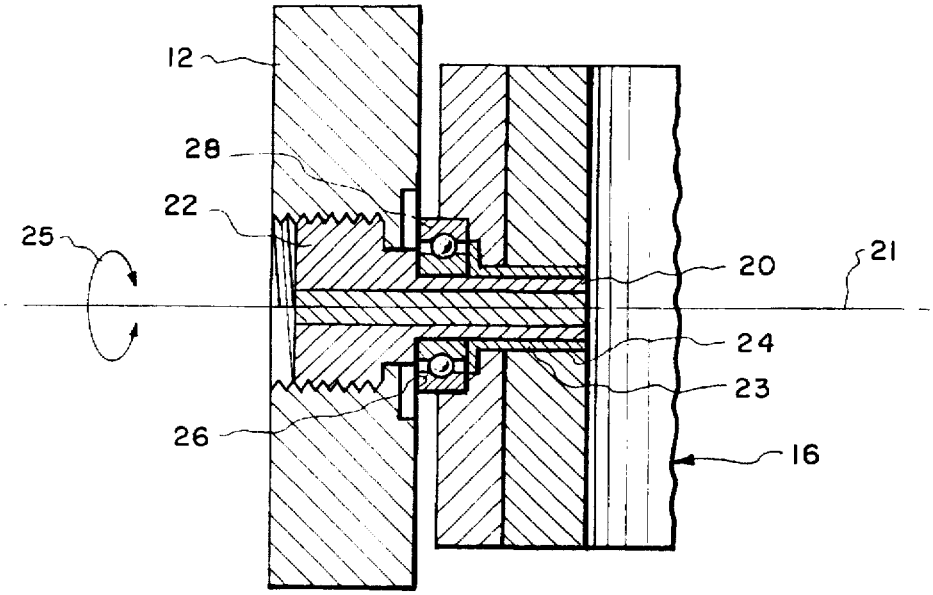
FIG. 5 is a view, in partial section, taken along line 5—5 of FIG. 1 illustrating the shaft and roller bearing assembly for the pitch gimbal and left roll axis fork of the present invention.
Figure 6:
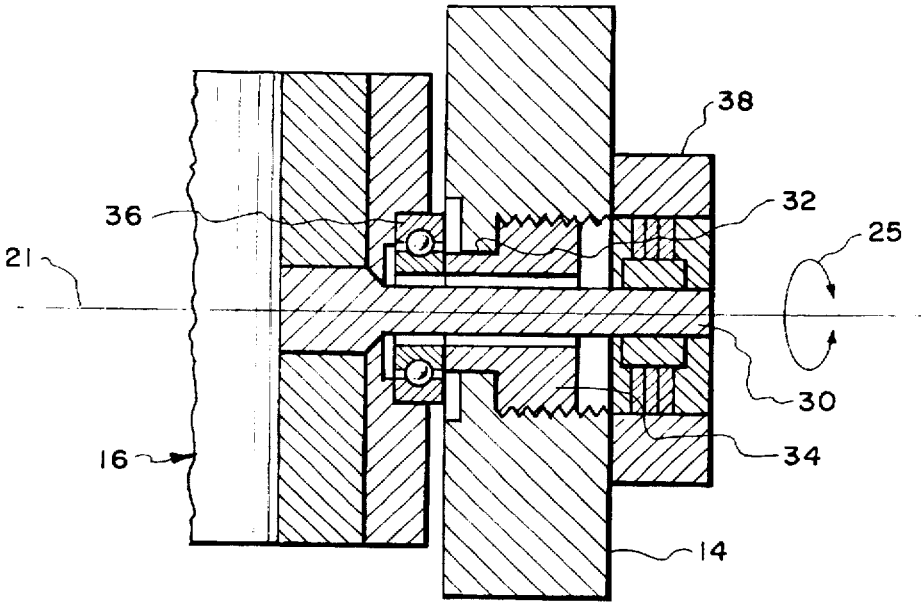
FIG. 6 is a view, in partial section, taken along line 6—6 of FIG. 1 illustrating the shaft and roller bearing assembly for the pitch gimbal and right roll axis fork of the present invention.

Free gyro 10 which is located within the dome 170 of a missile, includes a frame or support structure having a pair of roll axis forks 12 and 14 or support arms which support pitch gimbal 16 (FIGS. 5 and 6).

Referring to FIGS. 1 and 5, roll axis fork 12 has a shaft 20 and support structure 22 which is fixedly mounted in the roll axis fork 12 and which extends therefrom inwardly along the pitch axis 21 of free gyro 10. Pitch gimbal 16 has an aperture 24 which is positioned along pitch axis 21 as shown in FIG. 5. The aperture 24 of pitch gimbal 16 has a sleeve 23 mounted therein. Sleeve 23 receives the shaft 20 of roll axis fork 12. A ball bearing 28 is mounted within an indent 26 at the end of aperture 24 which is adjacent roll axis fork 12.

Referring to FIGS. 1 and 6, a shaft 30 fixedly attached to the opposite end of pitch gimbal 16 extends outwardly along pitch axis 21 into an aperture 32 within roll axis fork 14. There is also positioned within aperture 32 of fork 14 a sleeve 34 and ball bearing 36.

Ball bearing 28 and sleeve 23 as well as ball bearing 36 and sleeve 34 allow for a substantially frictionless rotational movement of pitch gimbal 16 about pitch axis 21 through an angle of rotation of approximately ±120 degrees as is best indicated by arrow 25.

A resolver/potentiometer 38 is mounted on roll fork axis 14 adjacent aperture 32 of fork 14 so that shaft 30 extends into potentiometer 38, allowing potentiometer 38 to sense the rotational movement of pitch gimbal 16 about pitch axis 21. Potentiometer 38 then provides electrical signals indicative of the angular position of pitch gimbal 16 to the missile's computer system.

Figure 2:
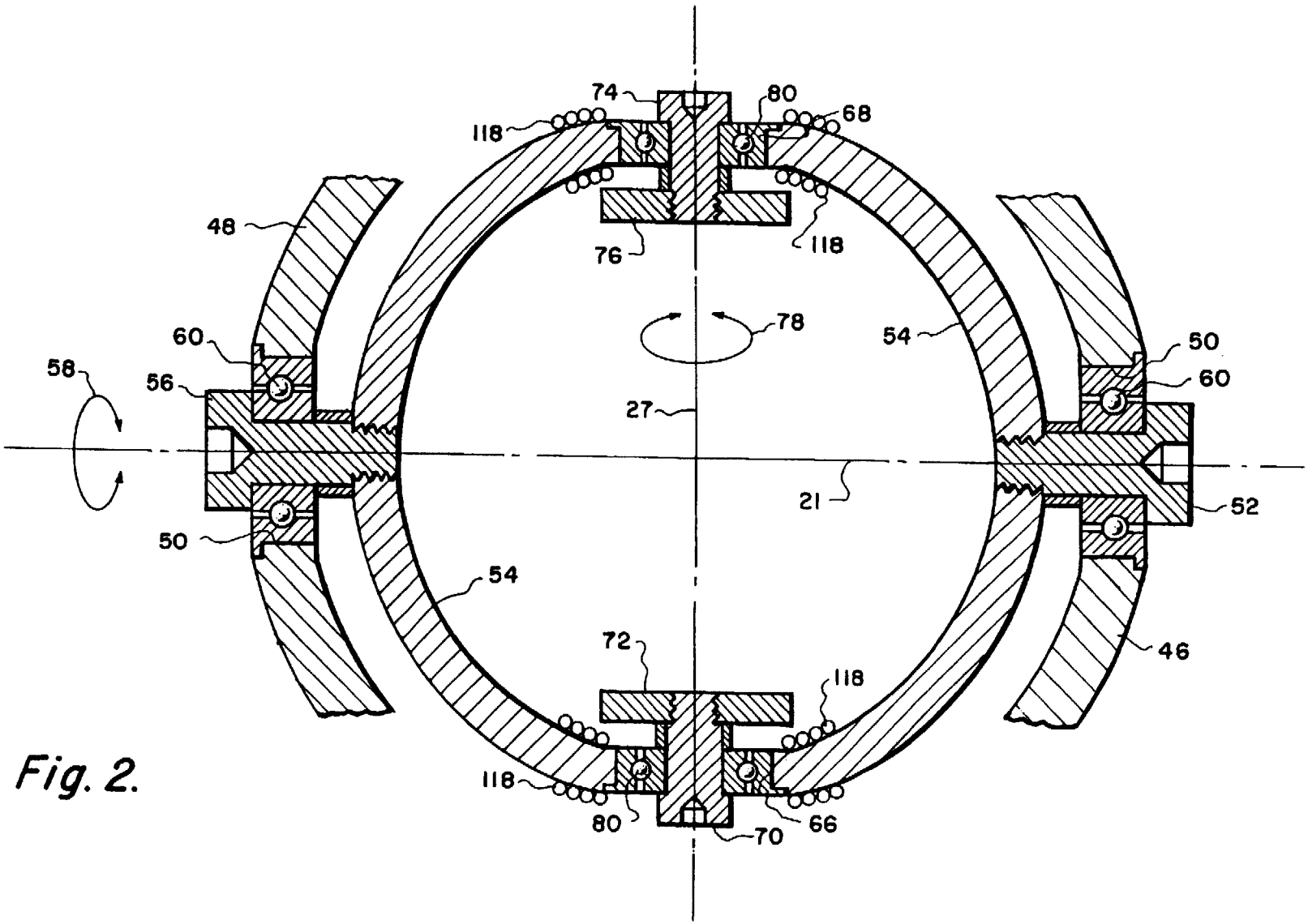
FIG. 2 is a diagrammatic view, in partial section, of the outer gimbal ring of the free gyro of FIG. 1.

Referring now to FIGS. 1 and 2, attached to pitch gimbal 16 is an outer gimbal support structure 40 which includes a stem 41 and a generally U shaped support member 42. As shown in FIG. 1 outer gimbal support structure 40 and U shaped support member 42 are centered about the roll axis 44 for free gyro 10. It should be noted that the longitudinal axis for the missile is roll axis 44.

The U shaped support member 42 has a pair of support posts 46 and 48 with each support post 46 and 48 having an opening 50. The opening 50 within each support post 46 and 48 of U shaped support member 42 is located on the pitch axis 21 of free gyro 10. Opening 50 of support post 46 receives a shaft 52 which is threadably connected to an outer gimbal ring 54, while opening 50 of support post 48 receives a shaft 56 which is also threadably connected to outer gimbal ring 54. Each shaft 52 and 56 is positioned on pitch axis 21 to allow for rotational movement of outer gimbal ring 54 about pitch axis 21 over an angle of ±20 degrees as is best indicated by arrow 58. Ball bearings 60 are mounted within each opening 50 about shafts 52 and 56 to allow for substantially frictionless rotational movement of outer gimbal ring 54 about pitch axis 21 through the ±20 degree angle of rotation indicated by arrow 58.

Figure 3:
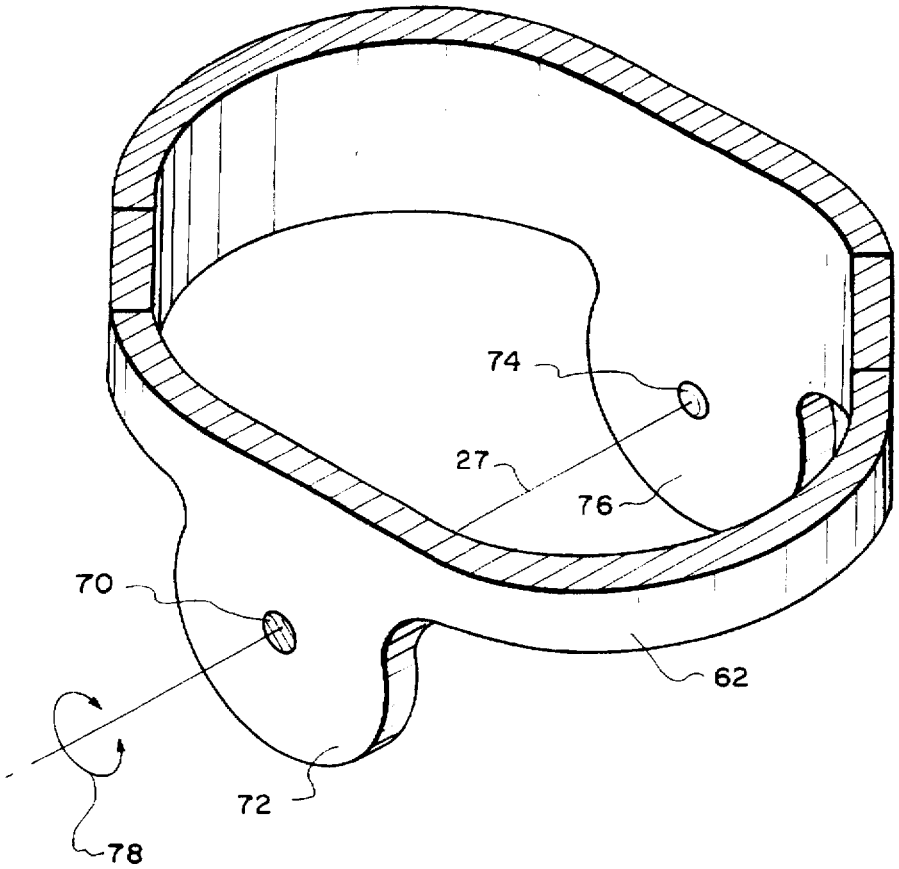
FIG. 3 is a diagrammatic view, in partial section, of the inner gimbal ring of the free gyro of FIG. 1.

Referring now to FIGS. 1, 2 and 3, FIG. 3 illustrates, in section, the inner gimbal ring 62 which supports the free gyro assembly and is designated generally by the reference numeral 64. The outer gimbal ring 54 has a pair of openings 66 and 68 which are located on the inner gimbal axis 27 of free gyro 10. As shown in FIG. 2, the inner gimbal axis 27 is perpendicular to pitch axis 21 and is positioned at the center of outer gimbal ring 54.

Opening 66 of outer gimbal ring 54 receives a shaft 70 which is threadably connected to a support arm 72 which extends downward from inner gimbal ring 62. In a similar manner, opening 68 of outer gimbal ring 54 receives a shaft 74 which is threadably connected to a support arm 76 which extends downward from inner gimbal ring 62. Each shaft 70 and 74 is positioned on inner gimbal axis 27 to allow for rotational movement of inner gimbal ring 62 about inner gimbal axis 27 over an angle of ±20 degrees as is best indicated by arrow 78. Ball bearings 80 are mounted within each opening 66 and 68 respectively about shafts 70 and 74 to allow for substantially frictionless rotational movement of inner gimbal ring 62 about inner gimbal axis 27 through the ±20 degree angle of rotation indicated by arrow 78.

Referring to FIGS. 1 and 4, free gyro assembly 64 includes a primary mirror and lens support structure 82 which has a primary mirror 172 and a circular flat lens 180 mounted therein, thereby providing support for primary mirror 174 and lens 180. Attached to support structure 82 is one end of a support post 84 which extends vertically upward along roll axis 44. A secondary mirror support member 86 is attached to the opposite end of support post 84. Affixed to the bottom surface of secondary mirror support member 86 is a secondary mirror 178. Attached to the top surface of secondary mirror support member 86 is a damper 88 which provides stability to free gyro assembly 64 when free gyro assembly 64 spins about roll axis 44.

Free gyro assembly 64 has a generally cylindrical shaped support member 90 which is attached to and extends downward from primary mirror and lens support structure 82 of free gyro assembly 64. Support member 90 has attached to its bottom edge a cylindrical shaped permanent magnet 92. Positioned between inner gimbal ring 62 (which functions as the spin axis support ring) and support member 90 is a spin axis bearing assembly 94. Spin axis bearing assembly 94 comprises a plurality of spin axis bearings 96 which allows free gyro assembly 64 to spin about roll axis 44 at a spin frequency of between about 100–200 hertz. The spinning of the free gyro assembly 64 about roll axis 44 stabilizes free gyro assembly 64.

There is mounted on an inner surface of pitch gimbal 16 a plurality of gyro motor drive coils 98. When energized by a direct current gyro motor drive coils 98 generate an electromagnetic field which interacts with the field of permanent magnet 92 resulting in permanent magnet 92 developing a spin torque about roll axis 44. This, in turn, spins free gyro assembly 64 about roll axis 44.

Stem 41 of outer gimbal support structure 40 has a plurality of rectangular shaped indents 100 which have cage coils 102 mounted therein. When energized cage coils 102 generate an electromagnetic field to align free gyro assembly 64 with roll axis 44 which boresights free gyro assembly 64 and its optical system which is depicted in FIG. 4.

Pitch gimbal 16 has a plurality of rectangular shaped indents 106 on its inner surface 108 and its outer surface 110. Mounted within indents 106 of outer surface 110 of pitch gimbal 16 are pitch axis precession coils 114. Mounted within indents 106 of inner surface 108 of pitch gimbal 16 are gyro precession coils 112. Mounted on each roll axis fork 12 and 14 of free gyro 10 is a pitch axis magnetic drive element/device 116 which may either a permanent magnet or electrical conductive coils (as shown in FIG. 1) or a combination thereof.

Control of rotational movement of pitch gimbal 16 about pitch axis 21 of free gyro 10 is provided by pitch axis precession coils 114 and pitch axis magnetic drive elements 116 of roll axis 12 and 14. When energized by a direct current pitch axis precession coils 114 generate an electromagnetic field which interacts with the field of pitch axis magnetic drive elements 116 resulting in magnetic drive elements 116 developing a torque about pitch axis 21. This, in turn, rotates pitch gimbal 16 about pitch axis 21. The angle of rotation of pitch gimbal 16 about pitch axis 21 is controlled by the strength of the current flowing through pitch axis precession coils 114, the number of individual coils comprising pitch axis precession coils 114, its polarity and the magnetic material used by the permanent magnets of free gyro 10.

Referring to FIGS. 1 and 3, control of rotational movement of inner gimbal ring 62 about inner gimbal axis 27 of free gyro 10 is provided gyro precession coils 112 of pitch gimbal 16 and permanent magnet 92. When energized by a direct current gyro precession coils 112 generate an electromagnetic field which interacts with the field of permanent magnet 92 resulting in magnet 92 developing a torque about inner gimbal axis 27. This, in turn, rotates inner gimbal ring 62 about inner gimbal axis 27. The angle of rotation of inner gimbal ring 62 about inner gimbal axis 27 is controlled by the strength of the current flowing through gyro precession coils 112, the number of individual coils comprising gyro precession coils 112, its polarity and the magnetic material used by the permanent magnets of free gyro 10.

Referring now to FIGS. 1 and 2, mounted on outer gimbal ring 54 are pitch axis precession coils 118 which interact with pitch axis magnetic drive element 116 to control the angle of rotation of outer gimbal ring 54 about pitch axis 21 with the angle of rotation of outer gimbal ring 54 being determined by the strength of the current flowing through pitch axis precession coils 118 and its polarity.

Referring again to FIG. 1, mounted on U shaped support member 42 of outer gimbal support structure 40 and the inner surface 108 of pitch gimbal 16 are a pair of hall effect devices 120 which senses the angular position of free gyro assembly 64 as the outer gimbal ring 54 rotates about the pitch axis 21 and the inner gimbal ring 62 rotates about the inner gimbal axis 27. The angular position of pitch gimbal 16 is monitored by resolver/potentiometer 38 of roll fork axis 14. The hall effect devices 120 and resolver/potentiometer 38 supply electrical signals to the missile's on board computer system indicative of the angular positions of pitch gimbal 16, outer gimbal ring 54 and inner gimbal ring 62.

There is also positioned within the stem 41 of outer gimbal support structure 40 a detector-dewar/cryostat assembly 122 which includes cooling coils 124 for maintaining seeker 190, FIG. 4, at a temperature which is sufficiently cool to allow seeker 190 to effectively operate in a tracking mode. The cooling coils 124 of assembly 122, which are in proximity with seeker 190 carry a liquid coolant, such as nitrogen, to seeker 190 to cool seeker 190. Seeker 190 is mounted within the stem 41 of outer gimbal support structure 40.

At this time it should be noted that torque motors, pulleys, drive belts and the like can be used to rotate free gyro 10 about roll axis 44. Rotating free gyro 10 about roll axis 44 would be in addition to rotating pitch gimbal 16 and outer gimbal ring 54 about pitch axis 21 and inner gimbal ring 62 about inner gimbal axis 27 in the manner described above. Thus, the seeker 190, FIG. 4, of free gyro 10 would be able to track and lock on to a target and then navigate the missile toward the target irregardless of the angle of the target with respect to the missile.

Referring now to FIGS. 1 and 4, FIG. 4 illustrates a lens or optical system suitable for use with free gyro 10. Light rays 171 and 173, which are reflected from the target (not illustrated) the missile is tracking, enter the missile through dome 170 traveling along optical or light paths 175 and 177 to primary mirror 172. Primary mirror 172, which has a concave reflective surface 174, directs light rays 171 and 173 respectively along optical paths 179 and 181 to the generally planar reflective surface 176 of secondary mirror 178. Secondary mirror 178 next directs light rays 171 and 173 respectively along optical paths 183 and 185 to lens 180 with light rays 171 and 173 passing through lens 180 to a condensing lens 184.

Condensing lens 184 which has a curved outer surface 188, is mounted on the outer gimbal support structure 40 of pitch gimbal 16. Condensing lens 184 condenses, and then directs light rays 171 and 173 along optical paths 187 and 189 to the seeker 190 of the missile. Thus, condensing lens 184 effectively functions to focus light energy from the target onto seeker 190.

The seeker 190, which is the target detecting device of the missile, converts the light rays 171 and 173 reflected from the target the missile is tracking to electrical signals by the missile's on board electronics, computer system and telemetry unit.

From the foregoing, it may readily be seen that the present invention comprises a new, unique and exceedingly useful free gyro for use with the tracking device of a missile or the like which constitutes a considerable improvement over the known prior art. Obviously many modifications and variations of the present invention are possible in light of the above teachings. It is therefore to be understood that within the scope of the appended claims that the invention may be practiced otherwise than as specifically described.

What is claimed is:

1. A free gyro for use with an electromagnetic radiation seeker mounted in a dome of a missile, said free gyro comprising:

a pair of roll axis forks mounted in the dome of said missile;

a pitch gimbal rotatably mounted on said pair of roll axis forks to rotate about a pitch axis orthogonal to the longitudinal axis of said missile, said pitch gimbal being adapted to rotate about said pitch axis through a first angle of rotation;

an outer gimbal ring rotatably mounted on said pitch gimbal to rotate about said pitch axis, said outer gimbal ring being adapted to rotate about said pitch axis through a second angle of rotation;

an inner gimbal ring rotatably mounted on said outer gimbal ring to rotate about an inner gimbal axis orthogonal to said pitch axis and to the longitudinal axis of said missile, said inner gimbal ring being adapted to rotate about said inner gimbal axis through a third angle of rotation;

a first plurality of pitch axis precession coils mounted within a plurality of indents on an outer surface of said pitch gimbal;

a pair of pitch axis magnetic drive devices, one of said pair of pitch axis magnetic drive devices being mounted on a first of said pair of roll axis forks and another of said pair of pitch axis magnetic drive devices being mounted on a second of said pair of roll axis forks;

a plurality of gyro precession coils mounted within a plurality of indents on an inner surface of said pitch gimbal;

a second plurality of pitch axis precession coils mounted on said outer gimbal ring;

a plurality of gyro motor drive coils mounted on an inner surface of said pitch gimbal; and a free gyro assembly rotatably mounted on said inner gimbal ring to spin about the longitudinal axis of said missile at a predetermined spin frequency;

said plurality of gyro motor drive coils providing a spin torque when energized to cause said free gyro assembly to spin about the longitudinal axis of said missile at said predetermined spin frequency;

said free gyro assembly including:

a cylindrical shaped support member;

a spin axis bearing assembly comprising a plurality of spin axis bearings, said spin axis bearing assembly being disposed between said inner gimbal ring and said cylindrical shaped support member to allow said free gyro assembly to spin about the longitudinal axis of said missile at said predetermined spin frequency; and a cylindrical shaped permanent magnet attached to said cylindrical shaped support member.

2. The free gyro of claim 1 wherein said first angle of rotation is approximately ±120 degrees.

3. The free gyro of claim 1 wherein said second angle of rotation and said third angle of rotation are each approximately ±20 degrees.

4. The free gyro of claim 1 wherein said predetermined spin frequency is between 100 to 200 hertz.

5. The free gyro of claim 1 wherein said each of said pair of pitch axis magnetic drive devices comprises a permanent magnet.

6. The free gyro of claim 1 wherein said each of said pair of pitch axis magnetic drive devices comprises a plurality of electrical conductive coils.

7. A free gyro for use with an electromagnetic radiation seeker mounted in a dome of a missile, said free gyro comprising:

a pair of roll axis forks mounted in the dome of said missile;

a pitch gimbal rotatably mounted on said pair of roll axis forks to rotate about a pitch axis orthogonal to the longitudinal axis of said missile, said pitch gimbal being adapted to rotate about said pitch axis through a first angle of rotation;

an outer gimbal ring rotatably mounted on said pitch gimbal to rotate about said pitch axis, said outer gimbal ring being adapted to rotate about said pitch axis through a second angle of rotation;

an inner gimbal ring rotatably mounted on said outer gimbal ring to rotate about an inner gimbal axis orthogonal to said pitch axis and to the longitudinal axis of said missile, said inner gimbal ring being adapted to rotate about said inner gimbal axis through a third angle of rotation;

a plurality of gyro motor drive coils mounted on an inner surface of said pitch gimbal;

a first plurality of pitch axis precession coils mounted within a plurality of indents on an outer surface of said pitch gimbal;

a pair of pitch axis magnetic drive devices, one of said pair of pitch axis magnetic drive devices being mounted on a first of said pair of roll axis forks and another of said pair of pitch axis magnetic drive devices being mounted on a second of said pair of roll axis forks;

a plurality of gyro precession coils mounted within a plurality of indents on said inner surface of said pitch gimbal;

a second plurality of pitch axis precession coils mounted on said outer gimbal ring;

a condensing lens mounted on said pitch gimbal; and a free gyro assembly rotatably mounted on said inner gimbal ring to spin about the longitudinal axis of said missile at a predetermined spin frequency;

said plurality of gyro motor drive coils providing a spin torque when energized to cause said free gyro assembly to spin about the longitudinal axis of said missile at said predetermined spin frequency;

said free gyro assembly including:

a cylindrical shaped support member;

a spin axis bearing assembly comprising a plurality of spin axis bearings, said spin axis bearing assembly being disposed between said inner gimbal ring and said cylindrical shaped support member to allow said free gyro assembly to spin about the longitudinal axis of said missile at said predetermined spin frequency;

a cylindrical shaped permanent magnet attached to said cylindrical shaped support member;

a primary mirror and lens support structure attached to an upper portion of said cylindrical shaped support member;

a primary mirror mounted on said primary mirror and lens support structure;

a circular flat lens mounted on said primary mirror and lens support structure;

a support post having one end thereof attached to said primary mirror and lens support structure, said support post extending upward along the longitudinal axis of said missile;

a secondary mirror support member attached to the opposite end of said support post; and a secondary mirror affixed to a bottom surface of said secondary mirror support member;

said condensing lens being positioned between said circular flat lens and said electromagnetic radiation seeker, said electromagnetic radiation seeker being mounted within said pitch gimbal.

8. The free gyro assembly of claim 7 wherein said primary mirror receives electromagnetic energy from a target and directs said electromagnetic energy to said secondary mirror, said secondary mirror next directs said electromagnetic energy from said target through said circular flat lens to said condensing lens, said condensing lens then condenses and focuses said electromagnetic radiation onto said electromagnetic radiation seeker.

9. The free gyro of claim 7 wherein said first angle of rotation is approximately ±120 degrees.

10. The free gyro of claim 7 wherein said second angle of rotation and said third angle of rotation are each approximately ±20 degrees.

11. The free gyro of claim 7 wherein said predetermined spin frequency is between 100 to 200 hertz.

12. The free gyro of claim 7 wherein said each of said pair of pitch axis magnetic drive devices comprises a permanent magnet.

13. The free gyro of claim 7 wherein said each of said pair of pitch axis magnetic drive devices comprises a plurality of electrical conductive coils.

14. The free gyro of claim 7 further comprising a damper attached to a top surface of said secondary mirror support member, said damper providing stability to said free gyro assembly.

15. The free gyro assembly of claim 7 further comprising a detector-dewar/cryostat assembly having cooling coils, the cooling cools of said detector-dewar/cryostat communicating with said electromagnetic radiation seeker to cool said electromagnetic radiation seeker.

16. The free gyro of claim 7 further comprising a pair of hall effect devices mounted on said pitch gimbal, said pair of hall effect devices sensing an angular position for said free gyro assembly, said pair of hall effect devices providing electrical signals indicative of an angular position for said free gyro assembly.

17. The free gyro of claim 7 further comprising a potentiometer coupled to said pitch gimbal to allow said potentiometer to sense rotational movement of said pitch gimbal about said pitch axis, said potentiometer providing an electrical signal indicative of an angular position for said pitch gimbal.

18. A free gyro for use with an electromagnetic radiation seeker mounted in a dome of a missile, said free gyro comprising:

a pair of roll axis forks mounted in the dome of said missile;

a pitch gimbal rotatably mounted on said pair of roll axis forks to rotate about a pitch axis orthogonal to the longitudinal axis of said missile, said pitch gimbal being adapted to rotate about said pitch axis through an angle of rotation of approximately ±120 degrees;

a potentiometer coupled to said pitch gimbal to allow said potentiometer to sense rotational movement of said pitch gimbal about said pitch axis, said potentiometer providing a first electrical signal indicative of an angular position for said pitch gimbal;

an outer gimbal ring rotatably mounted on said pitch gimbal to rotate about said pitch axis, said outer gimbal ring being adapted to rotate about said pitch axis through an angle of rotation of approximately ±20 degrees;

an inner gimbal ring rotatably mounted on said outer gimbal ring to rotate about an inner gimbal axis orthogonal to said pitch axis and to the longitudinal axis of said missile, said inner gimbal ring being adapted to rotate about said inner gimbal axis through an angle of rotation of approximately ±20 degrees;

a plurality of gyro motor drive coils mounted on an inner surface of said pitch gimbal;

a first plurality of pitch axis precession coils mounted within a plurality of indents on an outer surface of said pitch gimbal;

a pair of pitch axis magnetic drive devices, one of said pair of pitch axis magnetic drive devices being mounted on a first of said pair of roll axis forks and another of said pair of pitch axis magnetic drive devices being mounted on a second of said pair of roll axis forks;

a plurality of gyro precession coils mounted within a plurality of indents on an inner surface of said pitch gimbal;

a second plurality of pitch axis precession coils mounted on said outer gimbal ring;

a condensing lens mounted on said pitch gimbal;

a free gyro assembly rotatably mounted on said inner gimbal ring to spin about the longitudinal axis of said missile at a spin frequency between 100 to 200 hertz;

said plurality of gyro motor drive coils providing a spin torque when energized to cause said free gyro assembly to spin about the longitudinal axis of said missile at said spin frequency; and a pair of hall effect devices mounted on said pitch gimbal, said pair of hall effect devices sensing an angular position for said free gyro assembly, said pair of hall effect devices providing second and third electrical signals indicative of an angular position for said free gyro assembly;

said free gyro assembly including:

a cylindrical shaped support member;

a spin axis bearing assembly comprising a plurality of spin axis bearings, said spin axis bearing assembly being disposed between said inner gimbal ring and said cylindrical shaped support member to allow said free gyro assembly to spin about the longitudinal axis of said missile at said spin frequency;

a cylindrical shaped permanent magnet attached to said cylindrical shaped support member;

a primary mirror and lens support structure attached to an upper portion of said cylindrical shaped support member;

a primary mirror mounted on said primary mirror and lens support structure;

a circular flat lens mounted on said primary mirror and lens support structure;

a support post having one end thereof attached to said primary mirror and lens support structure, said support post extending upward along the longitudinal axis of said missile;

a secondary mirror support member attached to the opposite end of said support post; and a secondary mirror affixed to a bottom surface of said secondary mirror support member;

said condensing lens being positioned between said circular flat lens and said electromagnetic radiation seeker, said electromagnetic radiation seeker being mounted within said pitch gimbal; and said primary mirror receiving electromagnetic energy from a target and directing said electromagnetic energy to said secondary mirror, said secondary mirror next directing said electromagnetic energy from said target through said circular flat lens to said condensing lens, said condensing lens then condensing and focusing said electromagnetic radiation onto said electromagnetic radiation seeker.

19. The free gyro of claim 18 further comprising a damper attached to a top surface of said secondary mirror support member, said damper providing stability to said free gyro assembly.

20. The free gyro assembly of claim 18 further comprising a detector-dewar/cryostat assembly having cooling coils, the cooling cools of said detector-dewar/cryostat communicating with said electromagnetic radiation seeker to cool said electromagnetic radiation seeker.

* * * * *